US006995645B2

(12) United States Patent
Takiguchi et al.

(10) Patent No.: US 6,995,645 B2
(45) Date of Patent: Feb. 7, 2006

(54) IGNITER TRANSFORMER

(75) Inventors: Hisashi Takiguchi, Omihachiman (JP); Nobuaki Imamura, Omihachiman (JP); Tadao Nagai, Shiga-ken (JP); Masahiko Kitamoto, Rittou (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 112 days.

(21) Appl. No.: 10/666,599

(22) Filed: Sep. 18, 2003

(65) Prior Publication Data

US 2004/0125534 A1 Jul. 1, 2004

(30) Foreign Application Priority Data

Sep. 18, 2002 (JP) ..... 2002-271554

(51) Int. Cl.
*H01F 5/00* (2006.01)

(52) U.S. Cl. ..... 336/200

(58) Field of Classification Search ..... 336/65, 336/83, 199–208, 219–222, 232
See application file for complete search history.

(56) References Cited

U.S. PATENT DOCUMENTS 4,583,068 A * 4/1986 Dickens et al. ..... 336/82
5,359,150 A * 10/1994 Ikeuchi ..... 174/117 F
5,504,469 A * 4/1996 McGrane ..... 336/206
5,621,636 A * 4/1997 Tanigawa et al. ..... 363/147

FOREIGN PATENT DOCUMENTS

JP 01-110714 * 4/1989
JP 05-036538 * 2/1993
JP 2002-093635 3/2002

* cited by examiner

*Primary Examiner*—Tuyen T Nguyen
(74) *Attorney, Agent, or Firm*—Keating & Bennett, LLP

(57) ABSTRACT

An igniter transformer includes a secondary coil and a primary coil which are closely coupled. A plurality of round single-core wires disposed substantially parallel to one another in a common plane are bonded side by side to form a flat multicore wire that is substantially rectangular in cross-section. The secondary coil includes the flat multicore wire which is edgewise wound such that the larger surfaces of the flat multicore wire face each other in the turns while standing upright. The primary coil includes a wide thin metal sheet wound substantially perpendicularly to an axis of the secondary coil.

19 Claims, 13 Drawing Sheets

IGNITER TRANSFORMER

BACKGROUND OF THE INVENTION

1. Field of the Invention

The present invention relates to an igniter transformer and, in particular, to a coil structure of the igniter transformer.

2. Description of the Related Art

Conventionally, igniter transformers have been used as high-voltage generation units to ignite regular HID lamps (High Intensity Discharge Lamps), which are typically used for car headlights. An igniter transformer, as is shown schematically in FIG. 10, includes a magnetic core 21 having a substantially elliptic cross-section, a secondary coil 22 surrounding the magnetic core 21, and a primary coil 23 further surrounding the secondary coil 22, as is disclosed in Japanese Unexamined Patent Application Publication No. 2002-93635.

The secondary coil 22 is composed of a flat copper wire which is edgewise wound, that is to say, it is wound such that the larger surfaces of the flat wire face each other in the turns. The magnetic core 21 is disposed in the center hole of the secondary coil 22 with or without an insulating film (not shown in the drawing) being disposed therebetween. Similarly, the primary coil 23 is composed of a flat wire which is spirally wound around an insulating bobbin 24 that covers the secondary coil 22 in a so-called ribbon winding manner where one of the larger surfaces of the wire is in contact with the outer surface of the insulating bobbin 24.

This conventional igniter transformer has the following disadvantages. In order to make the igniter transformer thinner or lower in profile, it is necessary to flatten the secondary coil 22 so that the secondary coil 22 follows the cross-sectional shape of the magnetic core 21. However, the flat wire forming the edgewise-wound secondary coil 22 has high tensile strength and is thus difficult to process.

As shown in FIG. 11, which illustrates an enlarged side view of a bent portion 25, if the secondary coil 22 is flattened, partial bending of the flat wire will compress an inside portion 25*a* of the bent portion 25 more strongly than an outside portion 25*b*. Such partial bending may cause wrinkles 26 in the inside portion 25*a* of the bent portion 25, or may reduce the thickness of the outside portion 25*b* while increasing the thickness of the inside portion 25*a*, as shown in FIG. 12, which illustrates an enlarged sectional view of the relevant portion.

It is difficult to achieve a radius of curvature R that is less than 7.7 millimeters in the case of a flat wire having a width W of 1.5 millimeters and a thickness T of 75 micrometers. The widened inside portion 25*a* of the bent portion 25 increases the entire length of the edgewise-wound secondary coil 22 along the axis X of the secondary coil 22. As a result, the space factor of the secondary coil 22 is reduced from about 90%, which is normal, to about 70%.

Since the flat wire forming the secondary coil 22 has a rectangular cross-section, it is difficult to form an insulating coating (not shown) having a uniform thickness over the entire surface of the flat wire without a special electrodeposition process. The flat wire of the secondary coil 22 requires an insulating coating having a sufficient thickness of, for example, about 40 micrometers to maintain a desired withstand voltage. Thus, the space factor of the secondary coil 22 is reduced. Furthermore, a flat wire inherently causes eddy current loss, which may reduce the voltage generated by the igniter transformer.

Generating a high voltage requires close coupling of the secondary coil 22 and the primary coil 23 in a conventional igniter transformer. When the primary coil 23 is wound using the flat wire in the ribbon winding manner (shown in FIG. 13 illustrating a plan view of the winding) and a high output voltage, for example, 25 kV is required, a high-voltage terminal 23*a* of the primary coil 23 must be disposed substantially at the center of the entire length of the secondary coil 22 along the axis X of the secondary coil 22, namely, at the high-voltage side of the secondary coil 22 far beyond the maximum coupling point. Consequently, the inter-coil withstand voltage characteristics of the igniter transformer are degraded.

SUMMARY OF THE INVENTION

In order to overcome the problems described above, preferred embodiments of the present invention provide an igniter transformer wherein a secondary coil can be flattened without degrading the space factor, a uniform insulating coating can be coated on wires of the secondary coil, and the secondary coil and a primary coil are closely coupled so as to increase the inter-coil withstand voltage.

According to a preferred embodiment of the present invention, an igniter transformer includes a magnetic core, a secondary coil surrounding the magnetic core, a primary coil, and a plurality of round single-core wires, wherein the plurality of round single-core wires disposed substantially parallel to one another in a common plane are bonded side by side to form a flat multicore wire that is substantially rectangular in cross-section. The secondary coil is formed by the flat multicore wire which is edgewise wound such that the longer sides of the flat multicore wire face each other in the turns while standing upright. This structure eliminates excessive stress on each bent portion of the round single-core wires and the space factor of the secondary coil is not degraded even if the secondary coil including the edgewise-wound flat multicore wire is flattened. As a result, the thinner or lower-profile igniter transformer is advantageously provided.

Preferably, an igniter transformer includes the round single-core wire that has an insulating coating around the periphery of the round single-core wire and a fusible layer over the insulating coating, the flat multicore wire includes the plurality of round single-core wires consolidated by fusing the fusible layers of the round single-core wires, and the secondary coil includes a plurality of the flat multicore wires which are edgewise wound and the plurality of the flat multicore wires are bonded under pressure along the axis of the secondary coil such that the exposed fusible layers of the round single-core wires in the longer sides of the flat multicore wire are fused and the longer sides of the plurality of the flat multicore wires are bonded to each other. The secondary coil is defined by the flat multicore wire since the fusible layers of the round single-core wires are formed and the flat multicore wire is defined by fusing the fusible layers thereof. The round single-core wire advantageously allows formation of the insulating coating having a uniform thickness and the space factor of the secondary coil is increased.

Preferably, an igniter transformer includes the primary coil including a thin metal sheet that has a large width and that is wound substantially perpendicularly to the axis of the secondary coil. This structure allows the winding of the primary coil to be at the low-voltage side of the secondary coil with close coupling of the secondary coil and the primary coil. As a result, an inter-coil withstand voltage is advantageously increased.

Preferably, an igniter transformer includes the primary coil including a thin metal sheet that has a narrow width and that is wound substantially perpendicularly to the axis of the secondary coil, and the winding position of the primary coil shifts continuously in one direction along the axis of the secondary coil. Hence, the narrow thin metal sheet does not overlap in the turns. As a result, this structure advantageously provides close coupling of the secondary coil and the primary coil, and an inter-coil withstand voltage is increased.

Preferably, an igniter transformer includes a high-voltage terminal of the primary coil which is disposed substantially at the center of an entire length of the secondary coil along the axis of the secondary coil. This position is around a point where the coupling is maximized, advantageously resulting in an increased inter-coil withstand voltage.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1:
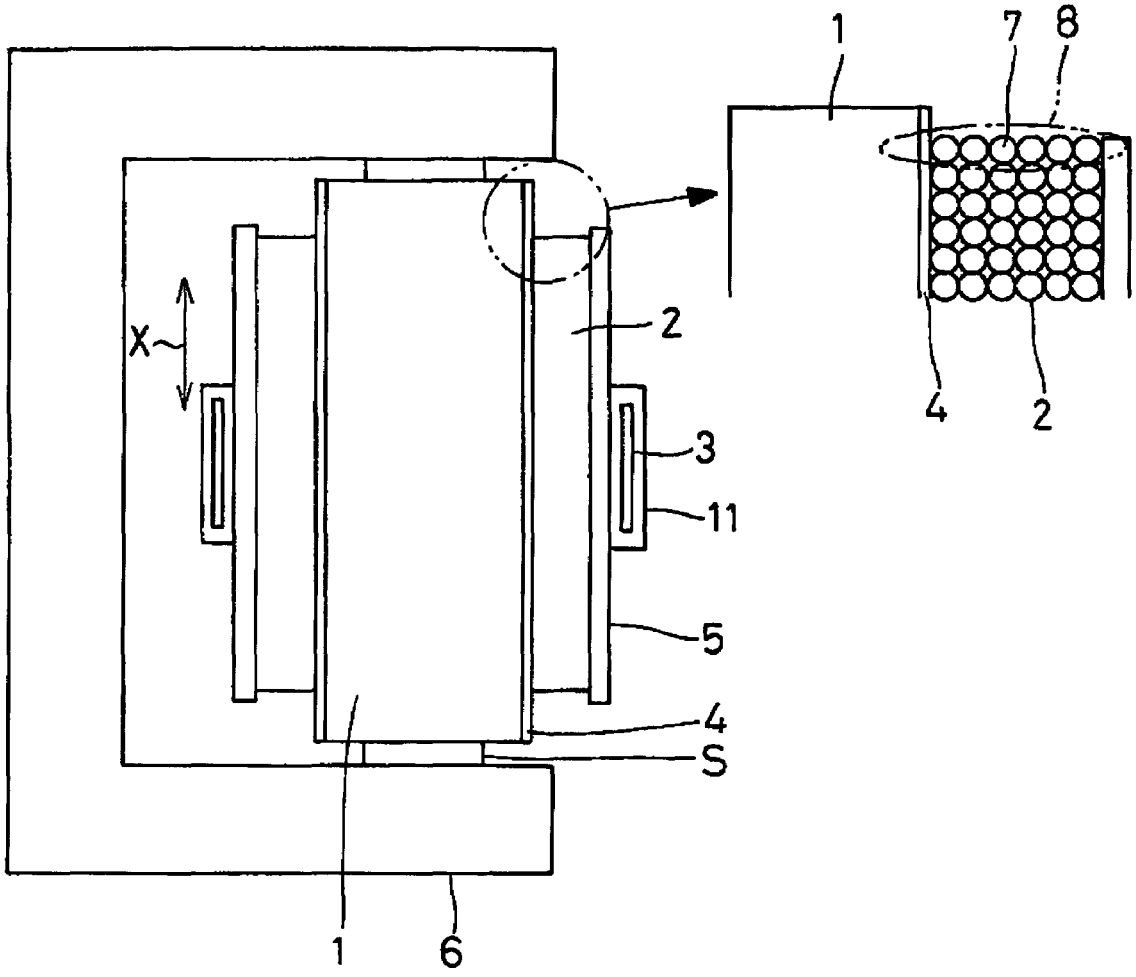
FIG. 1 is a sectional side view showing the overall structure of an igniter transformer according to a preferred embodiment of the present invention.

According to a preferred embodiment of the present invention, as schematically shown in FIG. 1, an igniter transformer includes a magnetic core 1 preferably having a substantially elliptic cross-section, a secondary coil 2 surrounding the magnetic core 1, and a primary coil 3 surrounding the secondary coil 2. An insulating film 4 is disposed between the outer surface of the magnetic core 1 and the inner surface of the secondary coil 2, while an insulating bobbin 5 is disposed between the outer surface of the secondary coil 2 and the inner surface of the primary coil 3. The magnetic core 1 is preferably made of NiZn having high resistance. The magnetic core 1 is connected to an outer core 6 via spacers S to form a UI core.

As shown in the partially enlarged view in FIG. 1, a plurality of round single-core wires 7 (six wires in the drawing) disposed substantially parallel to one another in a common plane are bonded side by side to form a flat multicore wire 8 that is substantially rectangular in cross-section. The secondary coil 2 includes the flat multicore wire 8 which is edgewise wound such that the larger surfaces of the flat multicore wire 8 face each other in the turns while standing upright. That is, as shown in FIG. 2 illustrating a relevant portion on an enlarged scale, each one of the round single-core wires 7 has an insulating coating 9 around its periphery and a fusible layer 10 over the insulating coating 9.

In this preferred embodiment, the round single-core wire 7 is not a flat wire. For example, the round single-core wire 7 preferably made of copper has a diameter of about 0.14 millimeters. The insulating coating 9 with a thickness of about 12 micrometers is easily formed on the surface of the round single-core wire 7. Moreover, the round single-core wire 7 allows formation of the insulating coating 9 having a uniform thickness by common coating techniques, and does not require special techniques such as electrodeposition.

Figure 2:
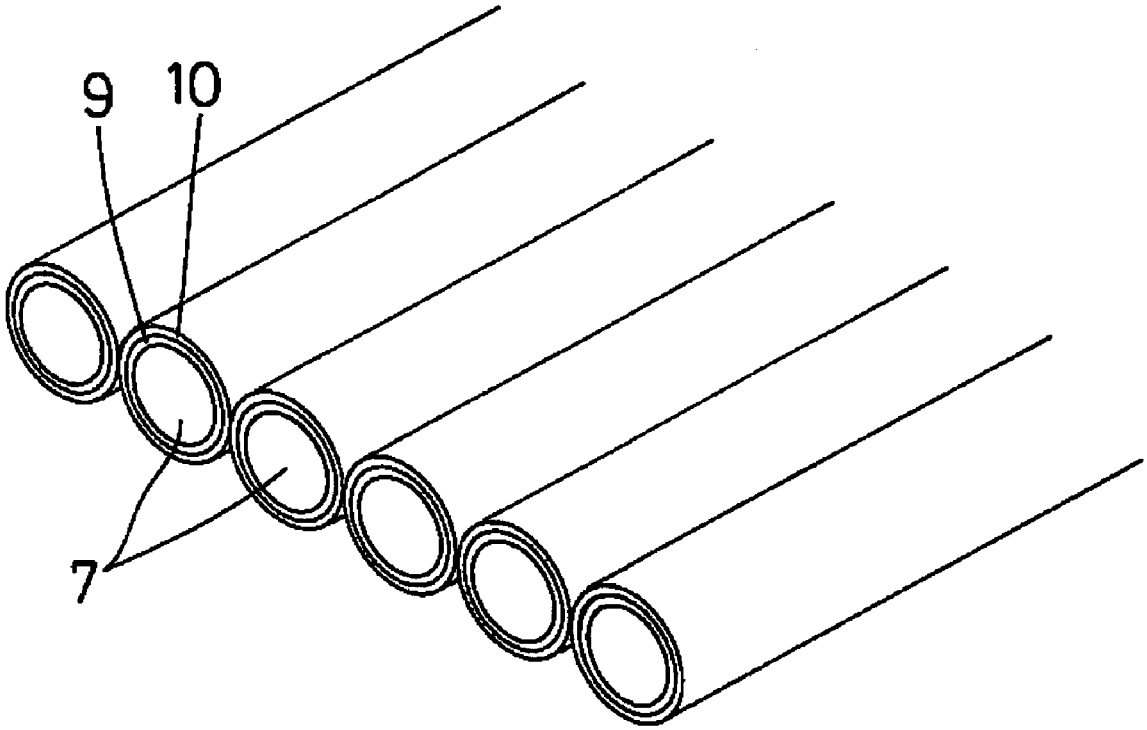
FIG. 2 is a sectional perspective view showing the structure of round single-core wires forming a flat multicore wire of a secondary coil according to a preferred embodiment of the present invention.
Figure 3:
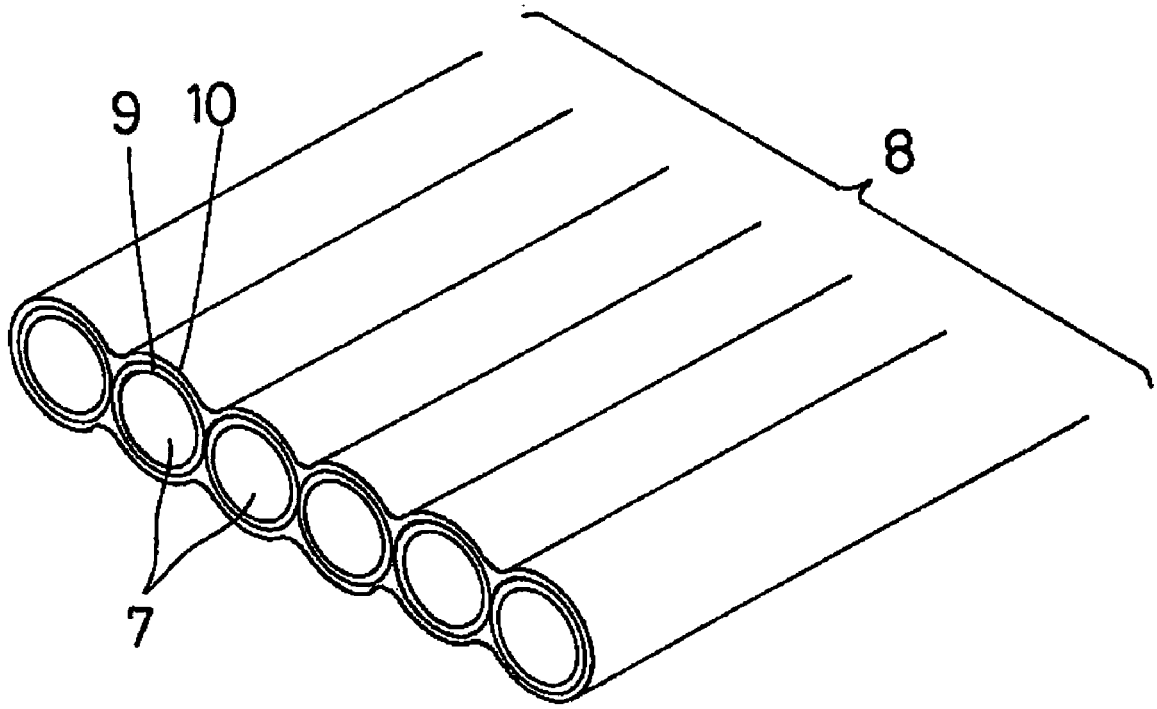
FIG. 3 is a sectional perspective view showing the structure of a flat multicore wire of a secondary coil according to a preferred embodiment of the present invention.

If the six round single-core wires 7 having the insulating coating 9 and the fusible layer 10 thereon are disposed substantially parallel to one another in a common plane, as shown in FIG. 2, heat from the round single-core wires 7 generated by electric currents through the wires fuses the fusible layer 10 of each round single-core wire 7 to bond them together, as shown in FIG. 3 illustrating the relevant portion on an enlarged scale. Hence, the six round single-core wires 7 form the flat multicore wire 8 that is substantially rectangular in cross-section. Of course, the number of the round single-core wires 7 is not limited to six. The number may increase or decrease as necessary. In addition, any heating process may be applied other than heating by an electric current.

Figure 4:
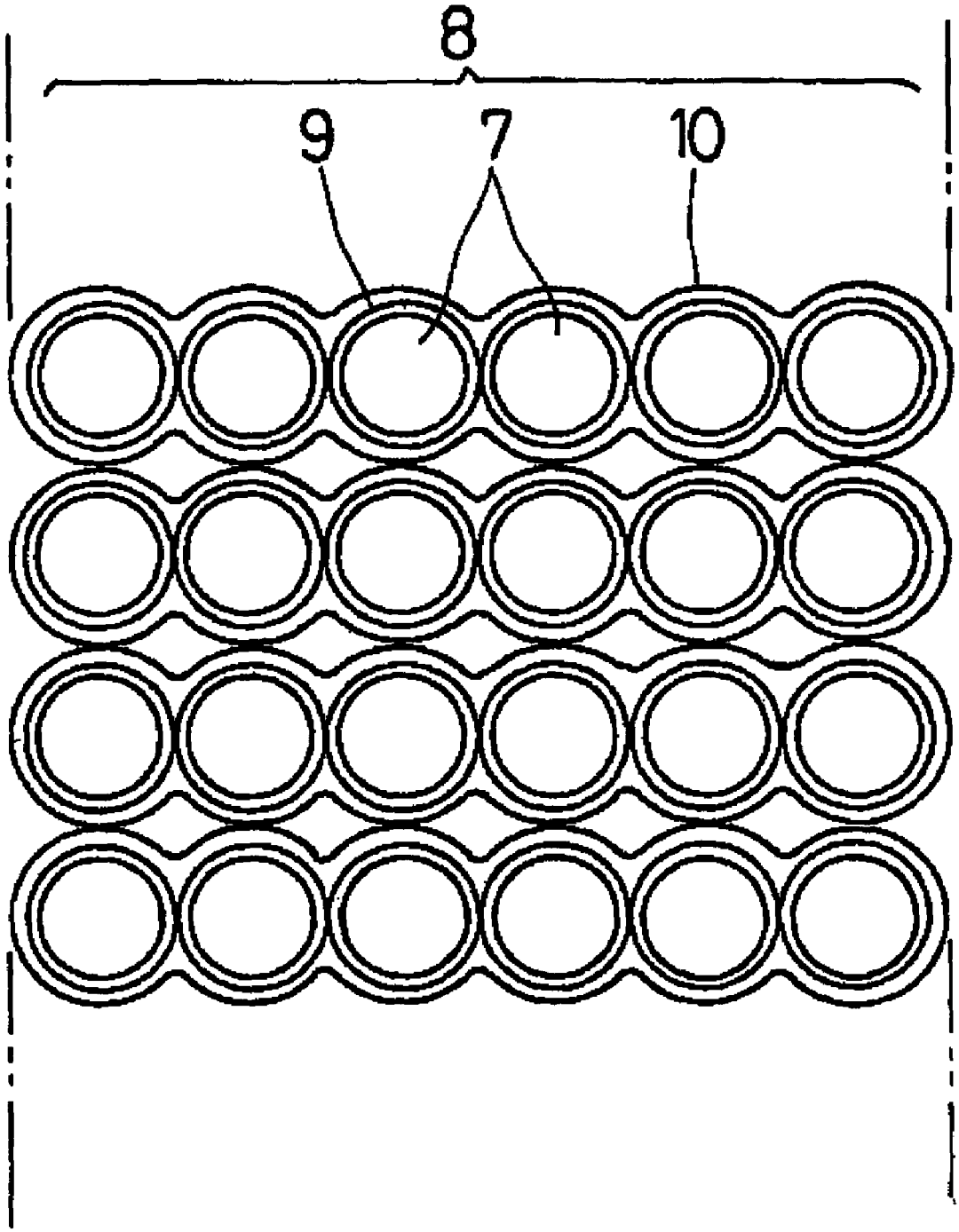
FIG. 4 is a sectional view showing steps for forming a secondary coil according to a preferred embodiment of the present invention.
Figure 5:
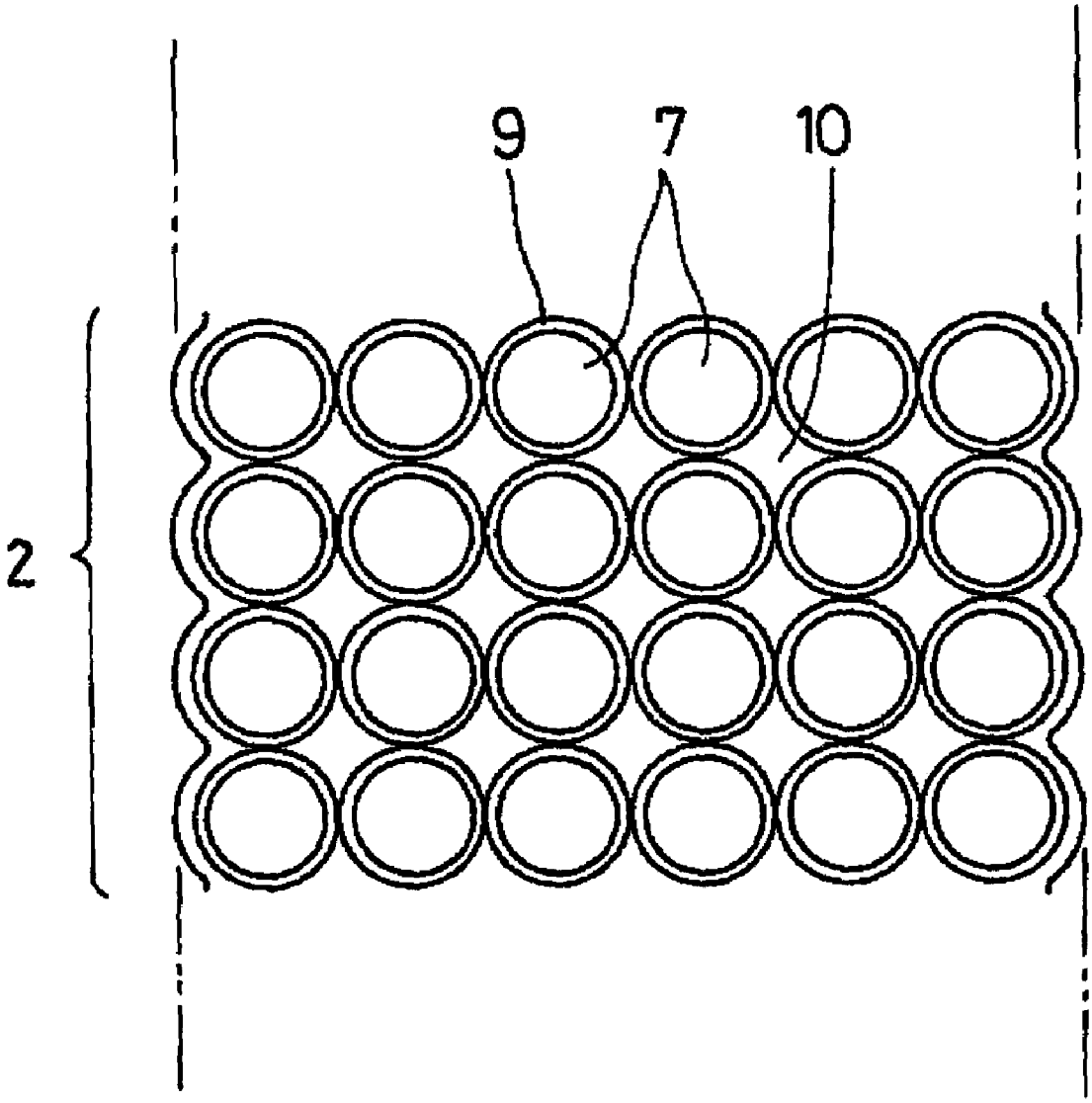
FIG. 5 is a sectional perspective view showing the structure of a secondary coil according to a preferred embodiment of the present invention.

Next, the flat multicore wire 8 is wound edgewise for about 200 turns, as shown in FIG. 4 illustrating the relevant portion on an enlarged scale, such that the larger planes of the flat multicore wire 8 are in contact with each other in the turns, and then heat is generated in the respective round single-core wires 7 by, for example, electric currents through the wires. As shown in FIG. 5 illustrating the relevant portion on an enlarged scale, the heat again fuses the fusible layers 10 of the respective round single-core wires 7 exposed at the larger planes of the flat multicore wire 8 and bonds the planes to form a bundle.

Pressure is preferably applied to the turns of the edgewise-wound flat multicore wire 8 along the axis of the secondary coil 2, since reducing the length of the secondary coil 2 requires the turns of the winding to be densely packed.

As a result, the secondary coil 2 is produced where six round single-core wires 7 disposed substantially parallel to one another in a common plane are bonded side by side to form a flat multicore wire 8 that is substantially rectangular in cross-section, and the flat multicore wire 8 is edgewise wound such that the larger planes of the flat multicore wire 8 face each other in the turns while standing upright. The magnetic core 1 is disposed in the edgewise-wound secondary coil 2 with the insulating film 4 therebetween. Alternatively, the magnetic core 1 may be formed without using the insulating film 4.

This structure eliminates excessive stress on each bent portion of the round single-core wires 7 even if the secondary coil 2 including the edgewise-wound flat multicore wire 8 is flattened to correspond to the cross-sectional shape of the magnetic core 1, since the round single-core wires 7 are more flexible and more compliant to the bends than a flat wire and are capable of bending independently. Accordingly, the space factor of the secondary coil 2 does not degrade. Instead, the space factor is maintained at about 80%. An investigation by the inventors of the present invention revealed that the radius of curvature of the bend for the round single-core wires 7 can be equal to or less than about 1 millimeter.

Figure 6A:
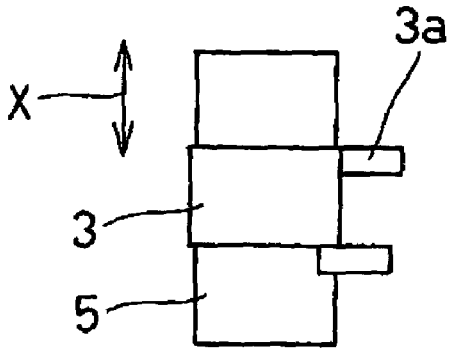
FIGS. 6A–6C are a plan view showing the structure of a primary coil according to a preferred embodiment of the present invention.
Figure 6B:
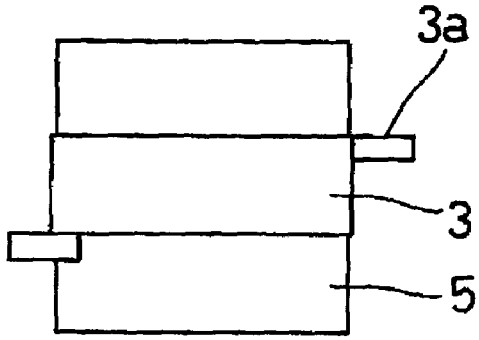

On the other hand, the igniter transformer according to this preferred embodiment includes a primary coil 3 on the outer periphery of the secondary coil 2 substantially at the center of the entire length of the secondary coil 2 along its X axis. As shown in FIG. 1, a wide thin metal sheet forming the primary coil 3 is embedded in an insulating film 11 having a given thickness. As shown in FIGS. 6A and 6B illustrating a plan view and a developed view of the winding, respectively, the wide thin metal sheet is wound on the insulating bobbin 5 surrounding the secondary coil 2 substantially perpendicularly to the axis X of the secondary coil 2 such that the outer surface of the bobbin 5 faces one of the larger surfaces of the wide thin metal sheet.

Figure 6C:
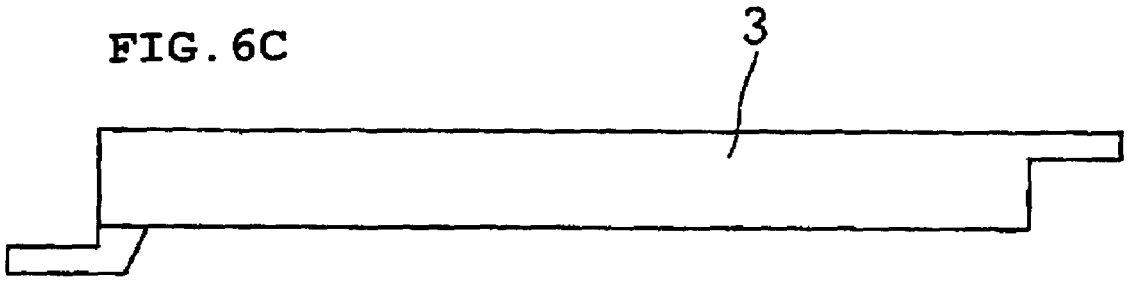

The primary coil 3 includes a substantially rectangular thin metal sheet or a ribbon wire having a large width with the developed shape shown in FIG. 6C. The wide thin metal sheet is wound around the outer periphery of the insulating bobbin 5 by about three turns, with the insulating film 11 between the turns. This winding structure positions a high-voltage terminal 3*a* of the primary coil 3, which is wound substantially perpendicularly to the axis X of the secondary coil 2, substantially at the center of the length of the secondary coil 2 along the X axis. This position is around a point where the coupling is maximized.

Figure 13:
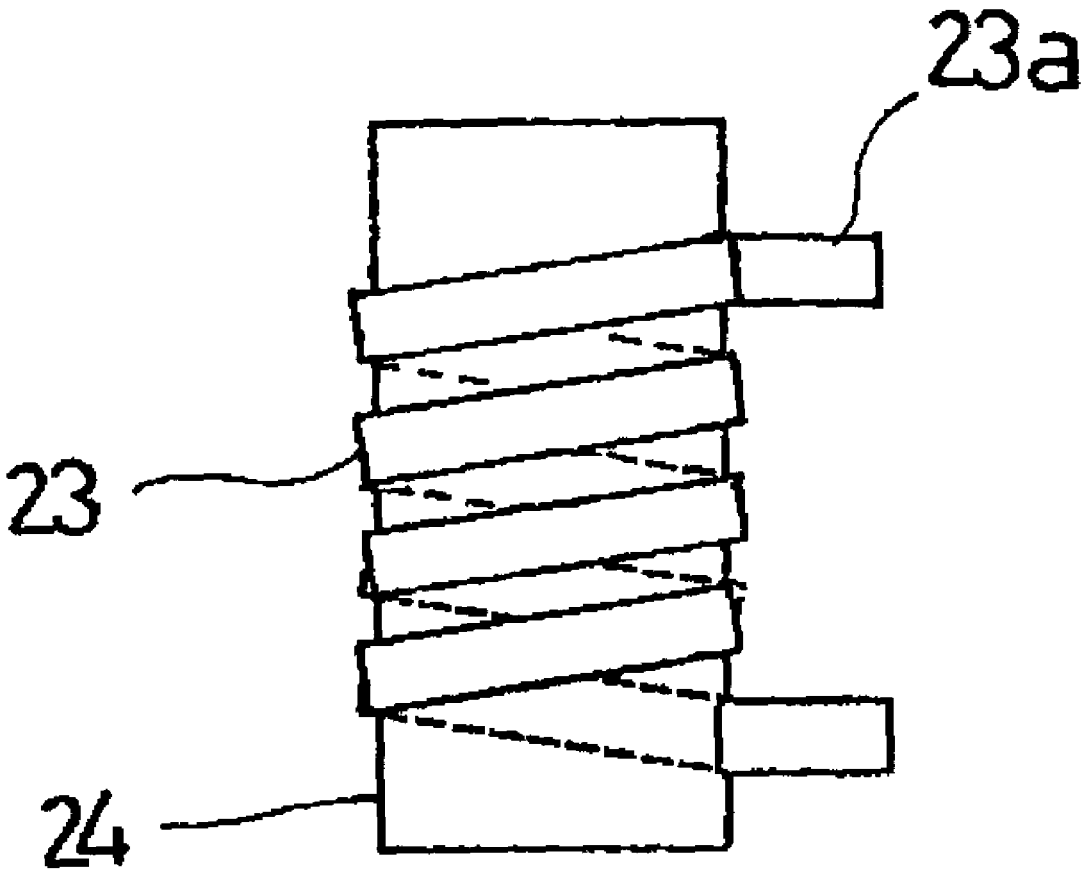
FIG. 13 PRIOR ART
FIG. 13 is a plan view showing the structure of a primary coil of a conventional igniter transformer.

Accordingly, unlike the conventional structure of the primary coil 23 having a ribbon-wound flat wire, as shown in FIG. 13, this structure can provide a high output voltage, such as 25 kV, to the igniter transformer without the winding of a primary coil 23 up to the high-voltage side of the secondary coil 22. In this structure according to a preferred embodiment of the present invention, the primary coil 3 and the secondary coil 2 are closely coupled and the winding of the primary coil 3 is at the low-voltage side of the secondary coil 2, advantageously resulting in an increased inter-coil withstand voltage.

Figure 7A:
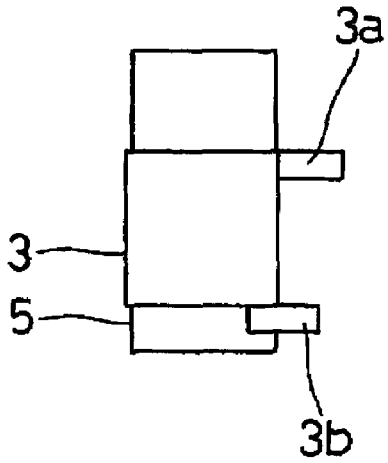
FIGS. 7A–7C are a plan view showing a first modification of the structure of the primary coil according to a preferred embodiment of the present invention.
Figure 7B:
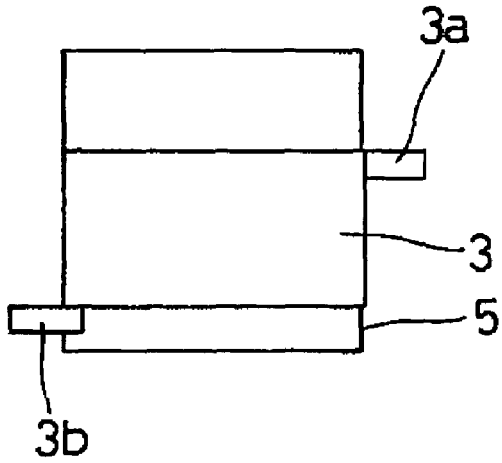
Figure 7C:
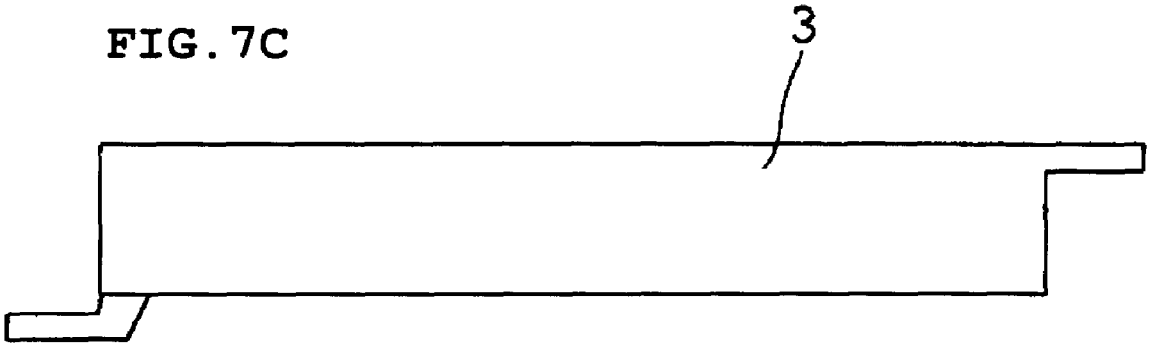

In this preferred embodiment of the present invention, the wide thin metal sheet forming the primary coil 3 is preferably wound substantially at the center of the entire length of the secondary coil 2 along the X axis of the secondary coil 2. In a first modification of this preferred embodiment of the present invention, as shown in FIGS. 7A and 7B illustrating a plan view and a developed view of the winding, respectively, a thin metal sheet forming the primary coil 3 may have a larger width, and a low-voltage terminal 3*b*, which is a starting point of the primary coil 3, may be disposed near the low-voltage end of the secondary coil 2 along the X axis of the secondary coil 2. FIG. 7C shows the developed shape of the sheet forming the primary coil 3.

Figure 8A:
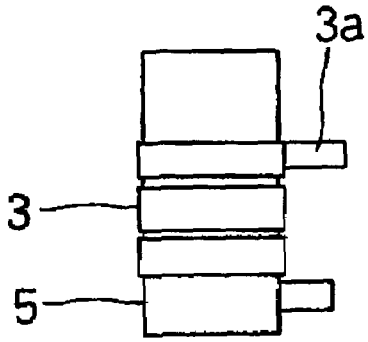
FIGS. 8A–8C are a plan view showing a second modification of the structure of the primary coil according to a preferred embodiment of the present invention.
Figure 8B:
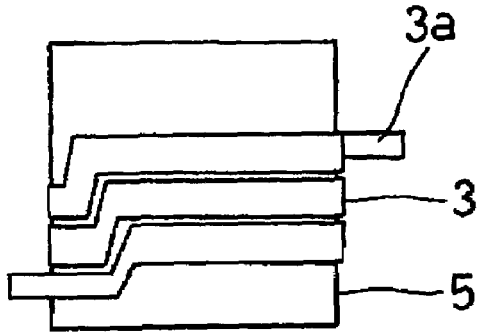
Figure 8C:
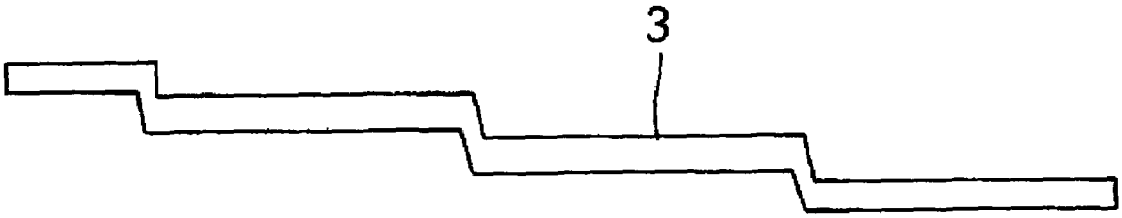

The metal sheet forming the primary coil 3 is not limited to a wide thin metal sheet. It may be a narrow thin metal sheet with the shape shown in FIG. 8C. In a second modification of this preferred embodiment of the present invention, as shown in FIGS. 8A and 8B illustrating a plan view and a developed view of the winding, respectively, the primary coil 3 includes the narrow thin metal sheet where the sheet is wound in a so-called Z-winding manner around the outer periphery of the insulating bobbin 5, with the respective turns being substantially parallel to one another.

Figure 9A:
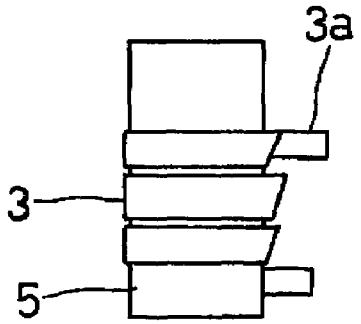
FIGS. 9A–9C are a plan view showing a third modification of the structure of the primary coil according to a preferred embodiment of the present invention.
Figure 9B:
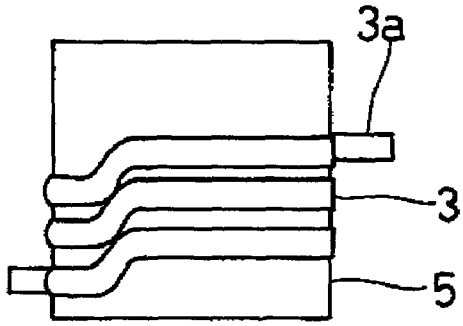
Figure 9C:
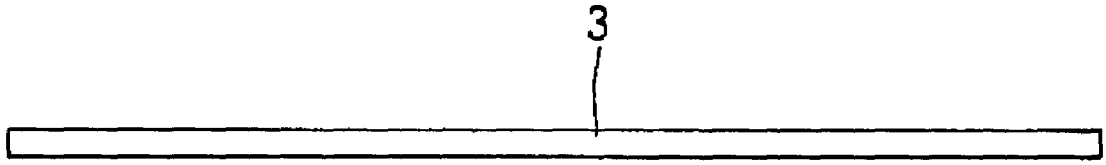
Figure 10:
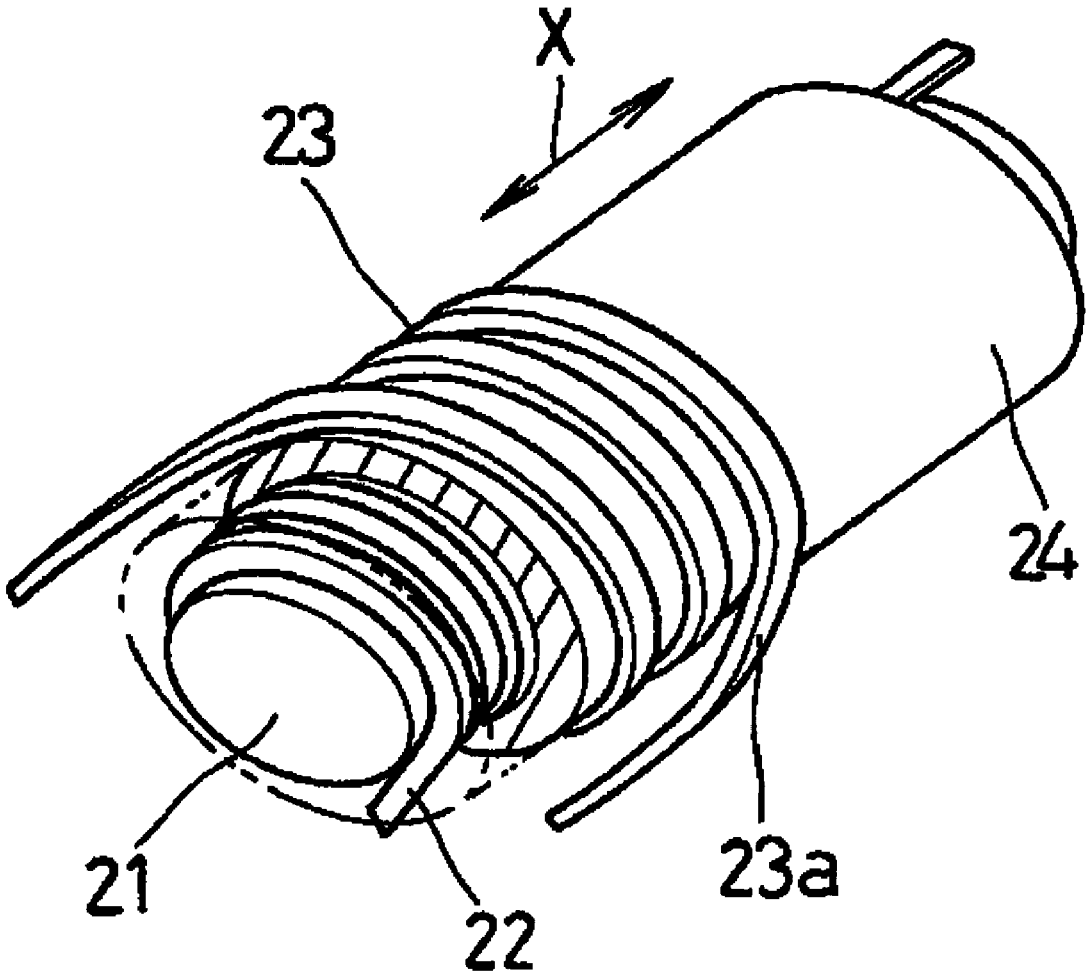
FIG. 10 PRIOR ART
FIG. 10 is a perspective view showing the overall structure of a conventional igniter transformer.
Figure 11:
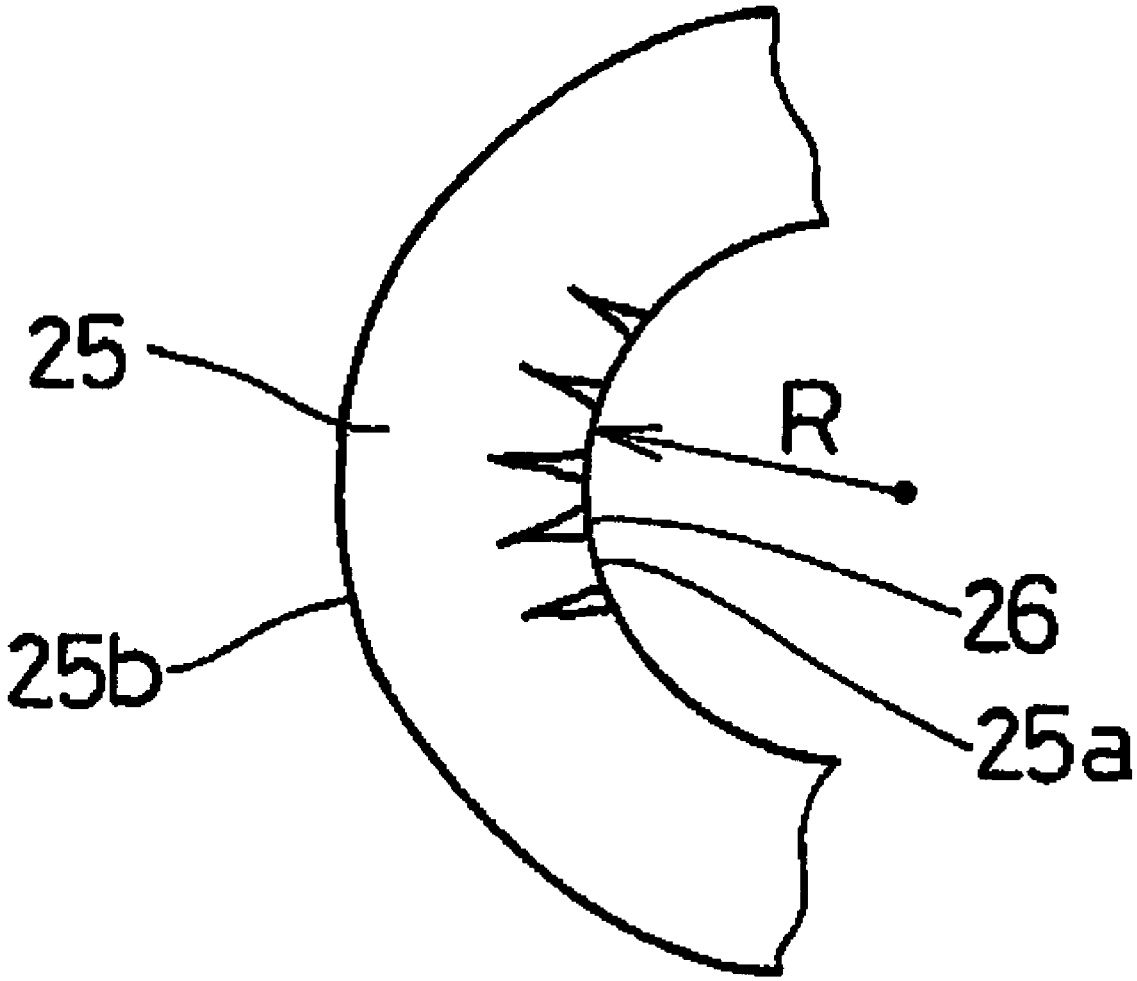
FIG. 11 PRIOR ART
FIG. 11 is a side view illustrating a bend in a flat wire forming a secondary coil of a conventional igniter transformer.
Figure 12:
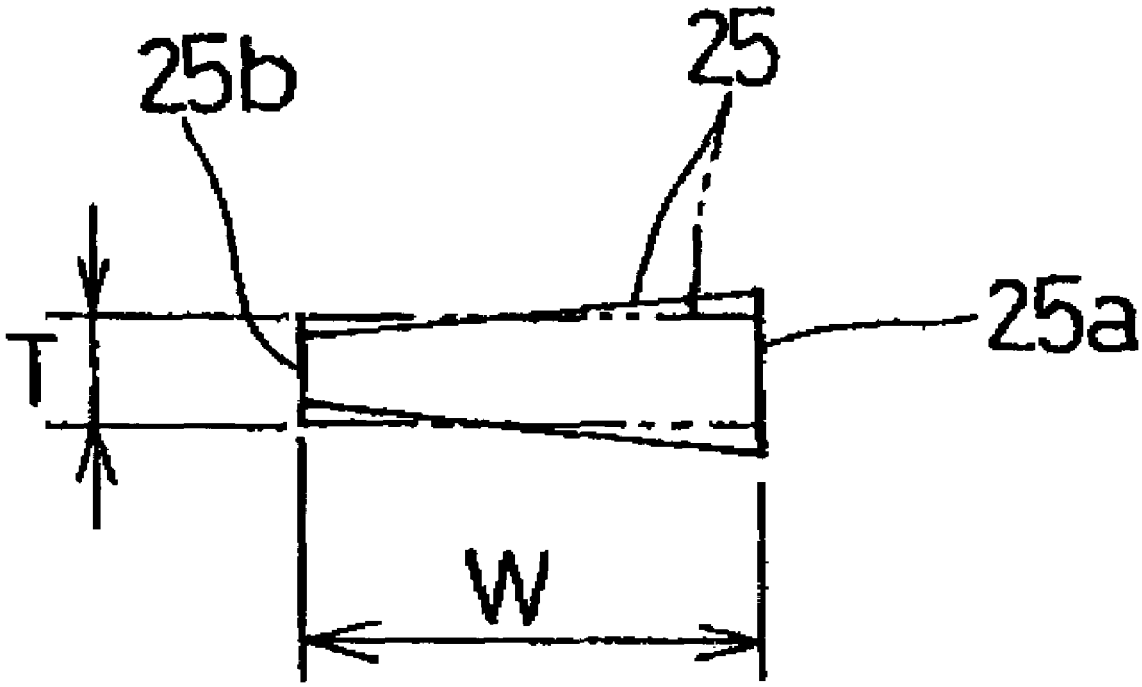
FIG. 12 PRIOR ART
FIG. 12 is sectional view illustrating a bend in a flat wire forming a secondary coil of a conventional igniter transformer.

In addition, the metal sheet forming the primary coil 3 may be a narrow thin metal sheet with the shape shown in FIG. 9C, that is, a typical ribbon wire. In a third modification of this preferred embodiment of the present invention, as shown in FIGS. 9A and 9B illustrating a plan view and a developed view of the winding, respectively, the narrow thin metal sheet forming the primary coil 3 is wound around the outer periphery of the insulating bobbin 5 in a so-called bank winding manner. This structure, however, requires a bank (not shown) to be previously formed in the insulating bobbin 5 and the narrow thin metal sheet should be wound along a guide of the bank. Use of the Z or bank winding of the narrow thin metal sheet does not require insulation for the primary coil 3, since the sheet does not overlap in the turns.

According to preferred embodiments of the present invention, the magnetic core 1 is preferably made of NiZn having high resistance. The magnetic core 1 may be made of at least one of MnZn and amorphous materials having low resistance. This type of magnetic core 1 requires insulation by an insulating bobbin (not shown) between the magnetic core 1 and the secondary coil 2 and by molding the entire outer surface of the primary coil 3 using epoxy resin or other suitable material.

According to various preferred embodiments of the present invention, a closed magnetic circuit configuration with a UI core is preferably used. An igniter transformer embedded in an HID lamp unit allows for a closed magnetic circuit configuration only with the magnetic core 1, resulting in a more compact igniter transformer. Furthermore, the primary coil 3 may be disposed by the side of the secondary coil 2 (not shown). This structure makes the igniter transformer much thinner.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. An igniter transformer comprising:

a magnetic core;

a secondary coil surrounding the magnetic core;

a primary coil; and a plurality of round single-core wires disposed substantially parallel to one another in a common plane, the plurality of round single-core wires being bonded side by side to form a flat multicore wire that is substantially rectangular in cross-section, the secondary coil being defined by the flat multicore wire which is edgewise wound such that longer sides of the flat multicore wire face each other in the turns.

2. An igniter transformer according to claim 1, wherein each of the round single-core wires includes an insulating coating around a periphery of the round single-core wire and a fusible layer over the insulating coating, the flat multicore wire includes the plurality of round single-core wires consolidated by fusing the fusible layers of the round single-core wires, and the secondary coil includes a plurality of the flat multicore wires which are edgewise wound and the plurality of the flat multicore wires are bonded under pressure along an axis of the secondary coil such that the exposed fusible layers of the round single-core wires in the longer sides of the flat multicore wire are fused and the longer sides of the plurality of the flat multicore wires are bonded to each other.

3. An igniter transformer according to claim 1, wherein the primary coil includes a thin metal sheet that is wound substantially perpendicularly to an axis of the secondary coil.

4. An igniter transformer according to claim 1, wherein the primary coil includes a thin metal sheet that is wound substantially perpendicularly to an axis of the secondary coil, and a winding position of the primary coil shifts continuously in one direction along the axis of the secondary coil.

5. An igniter transformer according to claim 3, wherein the primary coil has a high-voltage terminal which is disposed at an approximate center of an entire length of the secondary coil along an axis of the secondary coil.

6. An igniter transformer according to claim 1, wherein the magnetic core has a substantially elliptic cross-section.

7. An igniter transformer according to claim 1, wherein the magnetic core is made of NiZn.

8. An igniter transformer according to claim 1, wherein the magnetic core is made of at least one of MnZn and amorphous materials having low resistance.

9. An igniter transformer according to claim 1, further comprising an insulating film disposed between an outer surface of the magnetic core and an inner surface of the secondary coil.

10. An igniter transformer according to claim 1, wherein the primary coil surrounds the secondary coil.

11. An igniter transformer according to claim 10, further comprising an insulating bobbin disposed between an outer surface of the secondary coil and an inner surface of the primary coil.

12. An igniter transformer according to claim 11, wherein the primary coil is wound on the insulating bobbin surrounding the secondary coil substantially perpendicularly to an axis X of the secondary coil such that an outer surface of the insulating bobbin faces larger surfaces of the primary coil.

13. An igniter transformer according to claim 1, wherein the primary coil includes a ribbon wire.

14. An igniter transformer according to claim 1, wherein the number of the plurality of round single-core wires is six.

15. An igniter transformer according to claim 1, wherein each of the round single-core wires is made of copper and has a diameter of about 0.14 millimeters.

16. An igniter transformer according to claim 1, wherein the primary coil and the secondary coil are closely coupled and a winding of the primary coil is at the low-voltage side of the secondary coil.

17. An igniter transformer according to claim 11, wherein the primary coil includes a thin metal sheet wound in a Z-winding manner around an outer periphery of the insulating bobbin.

18. An igniter transformer according to claim 11, wherein the primary coil includes a thin metal sheet wound in a bank-winding manner around an outer periphery of the insulating bobbin.

19. A high intensity discharge lamp comprising an igniter transformer according to claim 1.

* * * * *